US008297345B2

(12) United States Patent
Emerson

(10) Patent No.: US 8,297,345 B2
(45) Date of Patent: Oct. 30, 2012

(54) DOWN HOLE ELECTRICAL CONNECTOR AND METHOD FOR COMBATING RAPID DECOMPRESSION

(76) Inventor: Tod D. Emerson, Cypress, TX (US)

( * ) Notice: Subject to any disclaimer, the term of this patent is extended or adjusted under 35 U.S.C. 154(b) by 194 days.

(21) Appl. No.: 12/026,276

(22) Filed: Feb. 5, 2008

(65) Prior Publication Data

US 2008/0185155 A1 Aug. 7, 2008

Related U.S. Application Data

(60) Provisional application No. 60/888,250, filed on Feb. 5, 2007, provisional application No. 60/894,841, filed on Mar. 14, 2007.

(51) Int. Cl.
*E21B 41/00* (2006.01)

(52) U.S. Cl. ..... 166/65.1; 166/242.6; 174/88 R; 439/587; 439/194

(58) Field of Classification Search ..... 166/65.1, 166/242.6; 174/84 R, 84 C, 88 R, 93; 439/587, 439/281, 191, 192, 194, 195
See application file for complete search history.

(56) References Cited

U.S. PATENT DOCUMENTS

| | | | | |
|---|---|---|---|---|
| 2,639,312 | A | 5/1953 | Kerwin | |
| 3,187,088 | A | 6/1965 | Warner | |
| 3,871,734 | A * | 3/1975 | Murtland | 439/275 |
| 4,422,504 | A | 12/1983 | Moore | |
| 4,614,392 | A | 9/1986 | Moore | |
| 4,627,490 | A | 12/1986 | Moore | |
| 4,781,607 | A | 11/1988 | Rumbaugh | |
| 4,783,227 | A | 11/1988 | Meador | |
| 4,854,886 | A * | 8/1989 | Neuroth | 439/192 |
| 4,859,200 | A | 8/1989 | McIntosh et al. | |
| 4,927,386 | A | 5/1990 | Neuroth | |
| 5,231,248 | A * | 7/1993 | Shah | 174/76 |
| 5,289,882 | A | 3/1994 | Moore | |
| 5,403,977 | A | 4/1995 | Steptoe et al. | |
| 5,478,970 | A | 12/1995 | Lawler et al. | |
| 5,495,755 | A | 3/1996 | Moore | |
| 5,567,170 | A | 10/1996 | Kroeber | |
| 5,577,925 | A | 11/1996 | Schnatzmeyer et al. | |
| 5,626,190 | A | 5/1997 | Moore | |
| 5,642,780 | A | 7/1997 | Moore | |
| 5,661,842 | A | 8/1997 | Faust | |
| 5,667,008 | A | 9/1997 | Moore | |
| 5,667,009 | A | 9/1997 | Moore | |
| 5,670,747 | A | 9/1997 | Lawer et al. | |
| 5,732,771 | A | 3/1998 | Moore | |

(Continued)

OTHER PUBLICATIONS

International Preliminary Report on Patentability, issued Aug. 11, 2009 (published Aug. 11, 2009) during the prosecution of International Application No. PCT/US2008/053016.

(Continued)

*Primary Examiner* — Nicole Coy
(74) *Attorney, Agent, or Firm* — David B. Dickinson

(57) ABSTRACT

Embodiments of the present invention provide an effective seal and connector that maintain a removable mechanical and electrical connection between any two down hole power cables, despite cable movement and well pressure. The connector preferably includes a fluid seal comprised an encasing material that surrounds and/or adheres to protective tubing encapsulating an electrical cable's conductor wires. The encasing material may also surround and/or adhere to the conductive wire's insulation to prevent its outward expansion during well pressure events. The connector's fluid seal also comprises a relatively rigid connection between the connector's protective outer sleeve and the protective tubing encapsulating the conductor wire.

13 Claims, 7 Drawing Sheets

U.S. PATENT DOCUMENTS

| | | | | |
|---|---|---|---|---|
| 5,762,135 | A | 6/1998 | Moore | |
| 5,797,761 | A | 8/1998 | Ring | |
| 5,823,256 | A | 10/1998 | Moore | |
| 5,907,966 | A | 6/1999 | Moore | |
| 5,974,848 | A | 11/1999 | Moore | |
| RE36,833 | E | 8/2000 | Moore et al. | |
| 6,202,743 | B1 | 3/2001 | Moore | |
| 6,409,485 | B1 | 6/2002 | Ebner | |
| 6,443,780 | B2 | 9/2002 | Wilbourn et al. | |
| 6,545,221 | B1 | 4/2003 | Halpert et al. | |
| 6,676,447 | B1 | 1/2004 | Knox | |
| 6,881,079 | B2 | 4/2005 | McHugh et al. | |
| 6,910,870 | B2 | 6/2005 | Ebner | |
| 6,931,194 | B2 | 8/2005 | Dowd et al. | |
| 6,943,298 | B2 | 9/2005 | Nicholson et al. | |
| 7,114,970 | B2 * | 10/2006 | Head | 439/191 |
| 7,232,347 | B1 | 6/2007 | Moore | |
| 7,405,358 | B2 * | 7/2008 | Emerson | 174/88 R |
| 2002/0013093 | A1 | 1/2002 | Wilbourn et al. | |
| 2004/0120837 | A1 | 6/2004 | Ebner | |

OTHER PUBLICATIONS

International Search Report issued Mar. 15, 2008 during the prosecution of International Application No. PCT/US2007/074674.

Written Opinion issued Mar. 15, 2008 during the prosecution of International Application No. PCT/US2007/074674.

* cited by examiner

DOWN HOLE ELECTRICAL CONNECTOR AND METHOD FOR COMBATING RAPID DECOMPRESSION

CROSS-REFERENCE TO RELATED APPLICATIONS

This application claims the benefit of U.S. Provisional Application Ser. No. 60/888,250, filed Feb. 5, 2007, and U.S. Provisional Application Ser. No. 60/894,841, filed Mar. 14, 2007, and the contents of such applications are hereby incorporated by reference in their entirety.

TECHNICAL FIELD

The present invention relates to an electrical cable connector apparatus and method for an underground well. More particularly, the present invention relates to a simplified, low cost down hole electrical connector, and method for blocking well fluids from entering the connector and escaping through electrical cable assembly to hazardous areas.

BACKGROUND OF THE INVENTION

Substantial difficulty has heretofore been encountered in providing a down hole connector assembly that prevents well fluids from permeating the connector and electrical cable assembly. Fluid entering the connector can cause electrical faults in the connector itself, and can also escape through permeable portions of the electrical cable assembly into low pressure hazardous areas such as electrical enclosures within the well, above ground areas near the wellhead barrier, and even to the power transformer. Explosions or fires may occur in hazardous areas due to gases and other substances associated with the production of petroleum products being ignited by electric arcs. This endangers personnel and the general public by creating risk of electrical shock or death by electrocution in or near the hazardous area.

So far as known to applicant, the current art has failed to overcome the above and other problems. A substantial need therefore exists to provide a satisfactory and safe method and apparatus for supplying electrical power from an above ground power source, through hazardous areas, and into a well where down hole electrical connections are made.

Present commonly employed electrical installations typically comprise a flexible corrugated housing with an internal electrical conductor means, such as an insulated conductive wire, that extends from the above ground power source through the wellhead barrier and into the well. It is substantially difficult, if not impossible, to initiate and/or maintain an effective seal where the corrugated cable passes through the wellhead barrier to prevent fluid discharge from the well. It is also substantially difficult to seal the internal elements of a down hole connector and electrical cable from being permeated by well fluids.

The above mentioned problems worsen when pressure changes occur in the well. Although pressure changes caused by the formation can by regulated to some extent by the electrical submersible pump ("ESP"), when the ESP is turned off, the well can reach pressures at the wellhead in excess of 5,000 to 10,000 pounds per square inch. The high pressure forces well fluids to penetrate seams or gaps in the connector and saturate permeable materials, such as the rubber boot of the connector and conductive wire insulation. Once the insulation is permeated, the fluid can flow through the electrical cable and out into hazardous areas creating a potentially explosive situation.

Currently known electrical installations have attempted to overcome the above mentioned problems by providing a connector made with an external protective sleeve that protects the internal rubber boots of the connector and prevents their outward expansion. The protective sleeve itself is typically comprised of two mating parts that allow the connection to be disconnected. However, even if the two parts of the shield are fastened or otherwise locked together, as is typical, the pressure differentials in the well often cause a piston effect between the rubber boots that forces the electrical connection apart. It is therefore desirable to provide a connector capable of remaining intact during pressurization and depressurization within the well.

Other electrical installations, such as those described in U.S. Pat. No. 4,614,392, Boyd B. Moore (the "'392 patent"), have attempted to solve the above mentioned problems with connectors positioned next to or inside of the encapsulated pressurized areas of the well. The '392 patent, for example, discloses how to seal electrical conductor wires that pass through a packer inside of steel tubes in order to provide conduction from a low pressure area above the packer to a high pressure area below the packer. In the '392, on either side of the packer, the steel tubes terminate using a known coupling assembly and insulator stand off provides the means to electrically isolate the crimp sleeve/connector socket joining the two conductor wires. It has been discovered, however, that in certain applications well fluids may penetrate the insulator stand off surrounding the connector socket and reach the conductive wire. Such fluid penetration causes the fluid to slowly escape to the low pressure area and into contact with the conductors. It is desired, therefore, to provide a more effective fluid seal, so that connectors placed in or near down hole pressurized areas will not leak fluids to low pressure areas.

Other commonly employed electrical installations have attempted to solve the above mentioned problems while, at the same time, providing a connecter than can be disconnected if the well, down hole equipment, electrical assembly, or other interconnected structures need to be removed. These installations typically comprise a connecter made with an attachment plug and a receptacle. The plug and receptacle design selectively connect and disconnect to terminate the above ground power source to down hole equipment. Under applicable regulations and/or industry standards the attachment plug and receptacle should have the same power rating as the device to which power is being supplied. However, so far as known to applicant, the attachment plug and receptacle connectors do not have such a rating and are incapable of withstanding an internal explosion without risk to the operator and drilling operations.

Another problem with the attachment plug and receptacle is that it frequently fails to stay connected when the well is suddenly pressurized or depressurized. During pressurization the connector's internal rubber boots often become impregnated with fluid and expand, which may force apart the connector's mating counterparts. During depressurization, fluid impregnated rubber boots may fail to release the fluids fast enough resulting a disconnect. It is therefore desirable to provide a down hole connector that can selectively terminate the above ground power source with down hole equipment that is not adversely affected by well pressures. Alternatively, it is desirable to provide a connector or an electrical cable connection assembly that can be efficiently and inexpensively cut off and replaced by a new connector or electrical cable connection assembly without substantial expense to the operator or delay in well operations.

SUMMARY OF THE INVENTION

To overcome the above and other problems, the preferred embodiment of the present invention includes a down hole connector that effectively seals the connector and internal elements of the electrical cable to prevent fluid discharge into hazardous areas. The preferred connector is sufficient to maintain a sealed mechanical and electrical connection between any two power cables, despite shifting and/or movement by the joined cables and well pressure events (pressurization and depressurization). The preferred connector is formed with a fluid sealing encasing material that surrounds and/or adheres to at least a portion of a the protective tubing surrounding an electrical cable's conductor wires. The encasing material may also surround and adhere to the conductive wire's insulation to prevent the insulation from changing physical dimensions during pressure events. A protective outer sleeve is positioned over the electrical cable so that it can engage the cable and be adhered to by the encasing material.

Another embodiment of the present invention employs a unique "hardwire connector" and/or method which the wires are crimped together within the connector. Optionally, the hardwire connector is attached to a cable extension piece that is made to be replaceable. The connector can be uncoupled and/or cut off and replaced with new connector and extension pieces to re-terminate the conductor wires.

In another embodiment, a connector comprises a protective outer sleeve for receiving and engaging at least one protective tubing encapsulating a down hole conductor wire; and a seal formed between the protective tubing and the protective outer sleeve; wherein the seal comprises: an encasing material for adhering to the protective tubing and protective outer sleeve and preventing fluid from passing between the protective tubing, protective outer sleeve and encasing material. Optionally, the encasing material is positioned within the connector to fill the space between the protective outer sleeve and the protective tubing. The seal may also restrict outward expansion of a fluid permeable material encapsulating a down hole conductor wire. Optionally, the down hole electrical cable is a tube extension cable adapted to selectively couple with a separate down hole electrical cable. Additionally, a bottom stop assembly is optionally positioned at least partially within the protective outer sleeve and adjacent to the encasing material; wherein the bottom stop assembly is adapted to receive and engage the protective tubing. The seal may further comprise a relatively rigid connection for impeding fluid flow; wherein the seal is formed between the protective outer sleeve, bottom stop assembly, and protective tubing. The bottom stop assembly is optionally adapted for receiving and engaging the terminus of the protective tubing, and may such engagement may be approximately two inches from the terminus of the protective tubing.

This rapid-decompression-inhibiting electrical connector sub-assembly comprises a protective outer sleeve; an insulating elastomeric boot; a bottom stop assembly providing a bushing accommodating the insertion of a protective tubing; an insulated electrical conductor inserted through the protective outer tubing into the insulating elastomeric boot; and, a fluid-impervious encasing material completely filing the interior space of the protective outer sleeve between the interior of the bottom stop assembly and the insulating elastomeric boot. The insulating elastomeric boot can also provide a chamfered edge adjoining the fluid-impervious encasing material compressing against an exterior of the insulated conductor inserted into the insulating elastomeric boot. Moreover, the insulating elastomeric boot can be fashioned with a male boot and a female boot. This new embodiment can also be used with an insulated electrical conductor with a lead jacket surrounding the insulation extending into the insulating elastomeric boot. An improved decompression-resistant down hole connector can be fabricated with a protective outer sleeve; a top stop assembly for receiving and engaging a first down hole electrical cable; wherein the top stop assembly providing a ferrule compressively seated against a protective outer tubing provides a metal to metal connection on a first protective outer tubing on the first down hole electrical cable; a bottom stop assembly for receiving and engaging a protective tubing of a second down hole electrical cable that electrically terminates with the first down hole electrical cable; wherein the bottom stop assembly is positioned at least partially within the protective outer sleeve enclosing the protective outer tubing extending through a bushing within the bottom stop assembly into an interior of the protective outer sleeve; at least one insulating boot with an axial passage for supporting a terminated first and second down hole electrical cable within the protective outer sleeve; and an epoxy filling the area between the protective outer tubing and the protective outer sleeve encasing the down hole electrical cables inserted in the insulating boot through the bottom stop assembly to prevent them from expanding and cracking. This improved embodiment can also provide an outer chamfered edge of the at least one insulating elastomeric boot to seal around the conductor inserted into the boot upon the compression of the space-filling epoxy encasing the conductor. The insulating boot can also be fashioned from a first male insulating boot and a separate second female insulating boot. The first down hole electrical cable can be a penetrator cable passing through a wellhead or packer, or alternatively, the second electrical conductor can be a pump cable. This electrical connector assembly joining a first electrical conductor to a second electrical conductor can be assembled utilizing a first insulated electrical conductor inserted through a protective tubing.

In another embodiment of the present invention a connector comprises a protective outer sleeve; a top stop assembly for receiving and engaging a first down hole electrical cable; wherein the top stop assembly is positioned at least partially within the protective outer sleeve; a bottom stop assembly for receiving and engaging the protective tubing of a second down hole electrical cable that electrically terminates with the first down hole electrical cable; wherein the bottom stop assembly is positioned at least partially within the protective outer sleeve; at least one insulating boot with an axial passage for supporting a terminated first and second down hole electrical cable within the protective outer casing; and a fluid tight seal for preventing fluid from entering the connector comprising an encasing material and a rigid connection; wherein the encasing material is affixed to protective tubing of a second electrical cable, bottom stop and protective outer sleeve, and the rigid connection is formed between the protective outer sleeve, bottom stop assembly, and protective tubing of the second electrical cable. Optionally, the insulating boot comprises a first male insulating boot and a separate second female insulating boot. The first down hole electrical cable is optionally penetrator cable; and the second down hole electrical cable is a pump cable.

A new method for providing a down hole connector provides the steps of receiving and engaging at least one down hole electrical cable with a protective outer sleeve, wherein the down hole electrical cable is formed with a conductor wire at least partially encapsulated in protective outer tubing, which tubing extends concentrically interior to the protective outer sleeve; inserting the protective tubing and electrical conductor into the interior of the protective outer sleeve extending beyond the bottom stop assembly; and, encasing the electrical cable and protective tubing of the down hole electrical connector in an epoxy within the protective outer sleeve to prevent expansion and splitting of the insulation of the electrical conductor and forming a connection between the protective outer sleeve and the protective outer tubing of the down hole electrical cable. This new method can further comprise the step of positioning a bottom stop assembly at least partially within a protective outer sleeve and adjacent to the encasing material so that the bottom stop assembly receives and engages the down hole electrical cable. Additionally, this new method can also provide the step of providing a down hole electrical cable involves providing a first electrical cable extension piece. This method can be further used to accomplish an installation of replacement electrical cable by disconnecting the first electrical cable from any separate attached down hole electrical cables; replacing the first down hole electrical cable extension piece with a second down hole electrical cable extension piece; and repeating the steps previously described above.

The foregoing has outlined the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. For example, embodiments of the connectors described herein may be used to join any type of cable, even though specific reference is made herein to down hole penetrators, pump cables, tube unions, main electrical cable, pothead cables, etc. Accordingly, for avoidance of doubt, the term cable, as used herein, includes any type of electrical cable, including those comprised of a conductive wire, insulation and/or protective tubing. The term cable may therefore refer to main electrical cable, pump cable, motor and extension cable ("MLE"), penetrator cable, and pothead cable, for example. In addition, the position of the improved connector within the well (although described herein as being positioned above, below, or near a packer or encapsulated pressurized area) may anywhere within or the well. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
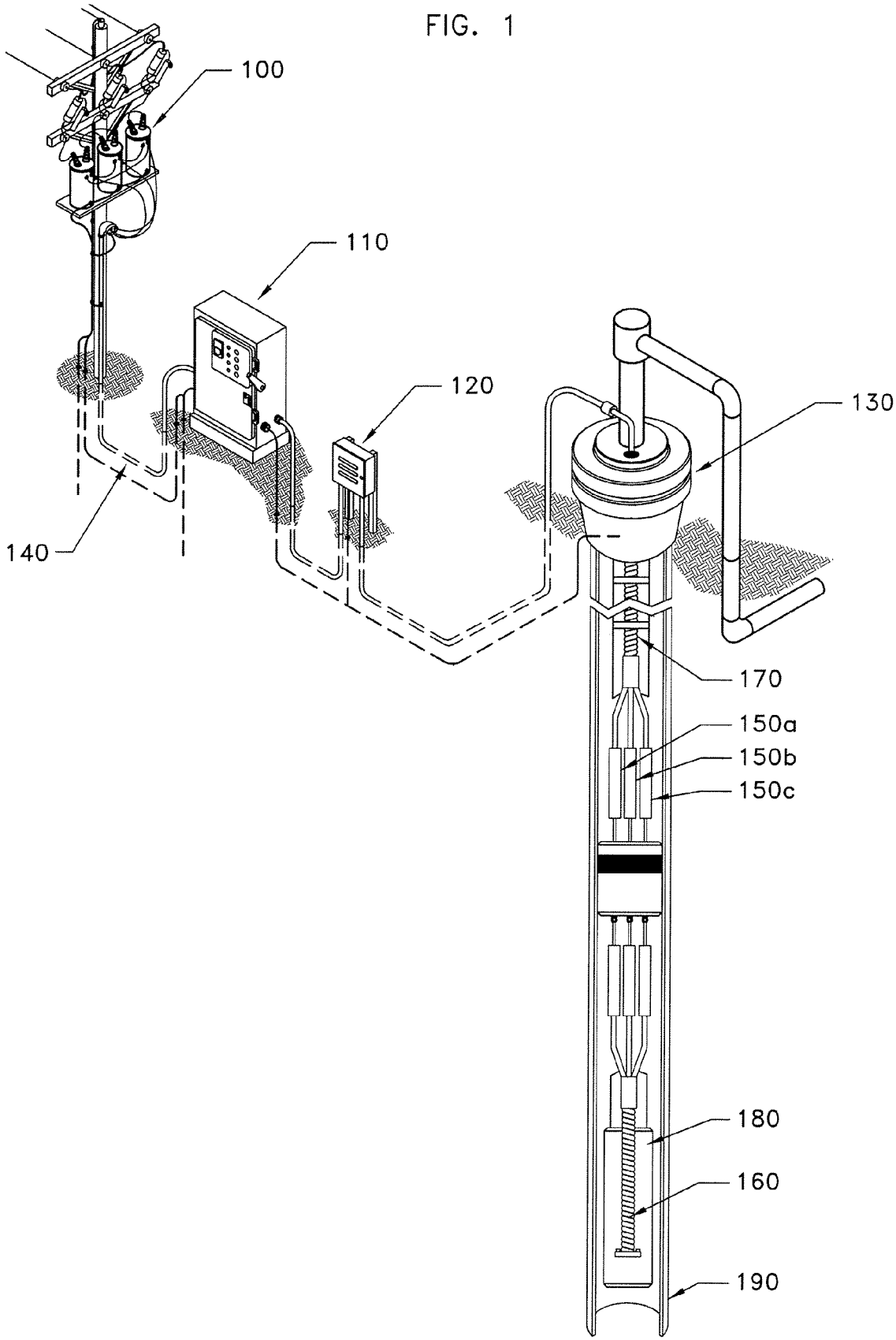
FIG. 1 shows a surface power source providing electrical power into a well to power down hole equipment connected by an example connector of the present invention.

FIG. 1 illustrates a preferred embodiment of the invention in which a remote surface power source 100 provides electrical power to down hole electrical equipment. The remote power source 100 is preferably a transformer bank, positioned on a power pole, which supplies power via cable 140 to motor control panel 110. Electrical cable 140 is typically formed of a medium voltage electrical conductor cable that runs from the motor control panel 110 in a known way to a vented junction box 120, and then into a wellhead barrier 130 of an underground well. Inside the well, cable 170 extends from the wellhead barrier 130 below to a position down hole where an electrical connection will be made with a cable using preferred and alternative embodiments of the present invention. The connectors 150*a*, 150*b*, and 150*c* that are shown in FIG. 1 are each individually shown in FIGS. 1-8 as connector 150. The connectors provide the means for electrically and mechanically connecting cable 170 and cable 160 inside the well.

In typical installations, cable 170 extends down a substantial portion of the well to the operating depth where it connects with cable 160. The operating depth preferably ranges from 1,000 to 15,000 feet, however, there is no practical maximum operating depth.

FIG. 1 shows a preferred embodiment in which cable 170 is a main electrical cable that is mechanically and electrically connected with cable 160, the MLE cable near the operating depth. The main electrical cable may be banded to the production tubing in a known way as it extends down the drill casing. The MLE cable may also be banded to the production tubing, or the ESP assembly, or other down hole equipment in a known way.

Figure 2:
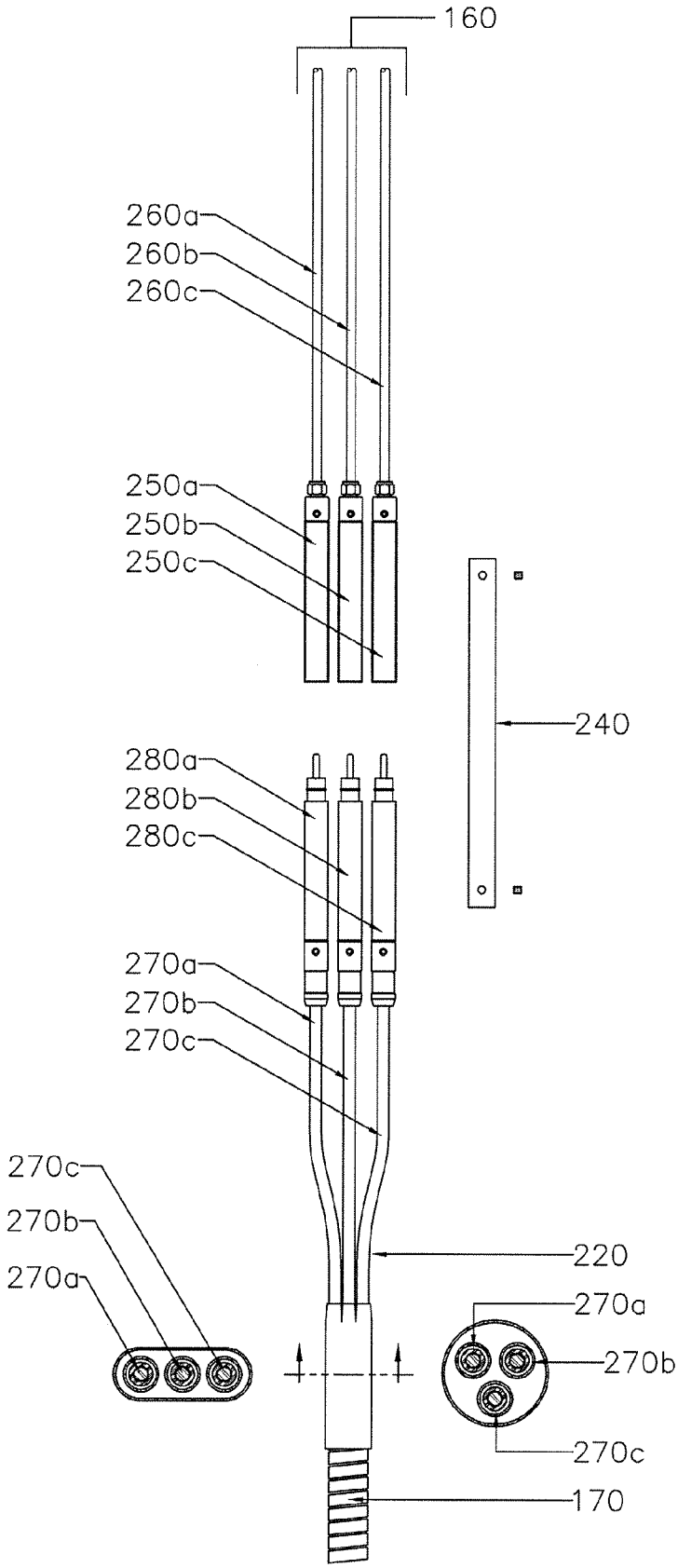
FIG. 2 shows a side view of an example female connector assembly, attached to a three phase down hole electrical cable, and an example male connector assembly, attached to another down hole electrical cable, that can be plugged in and engaged by a protective outer sleeve.

Cable 170 and cable 160 are shown in FIG. 2 in a side view. Cable 160 preferably includes three insulated conductor wires in protective tubing 260*a*, 260*b*, and 260*c*, which may be fitted with either male connector assemblies 280*a*, 280*b*, 280*c* or female connector assemblies 250*a*, 250*b*, 250*c*. Preferably, cable 160 is fitted with the female connector assemblies as shown in FIG. 2. Cable 170 is comprised of three insulated conductor wires 270*a*, 270*b*, and 270*c*, each of which are electrically terminated at the surface power source 100 (See FIG. 1) and fitted with either male connector assemblies 280*a*, 280*b*, 280*c* or female connector assemblies 250*a*, 250*b*, 250*c*. Preferably, the cable 170 is fitted with the male connector assemblies as shown in FIG. 2. Cable 170 is preferably formed to exhibit a round or flat lateral dimension, as shown in FIG. 2's cross sectional views.

Figures 3A, 3B:
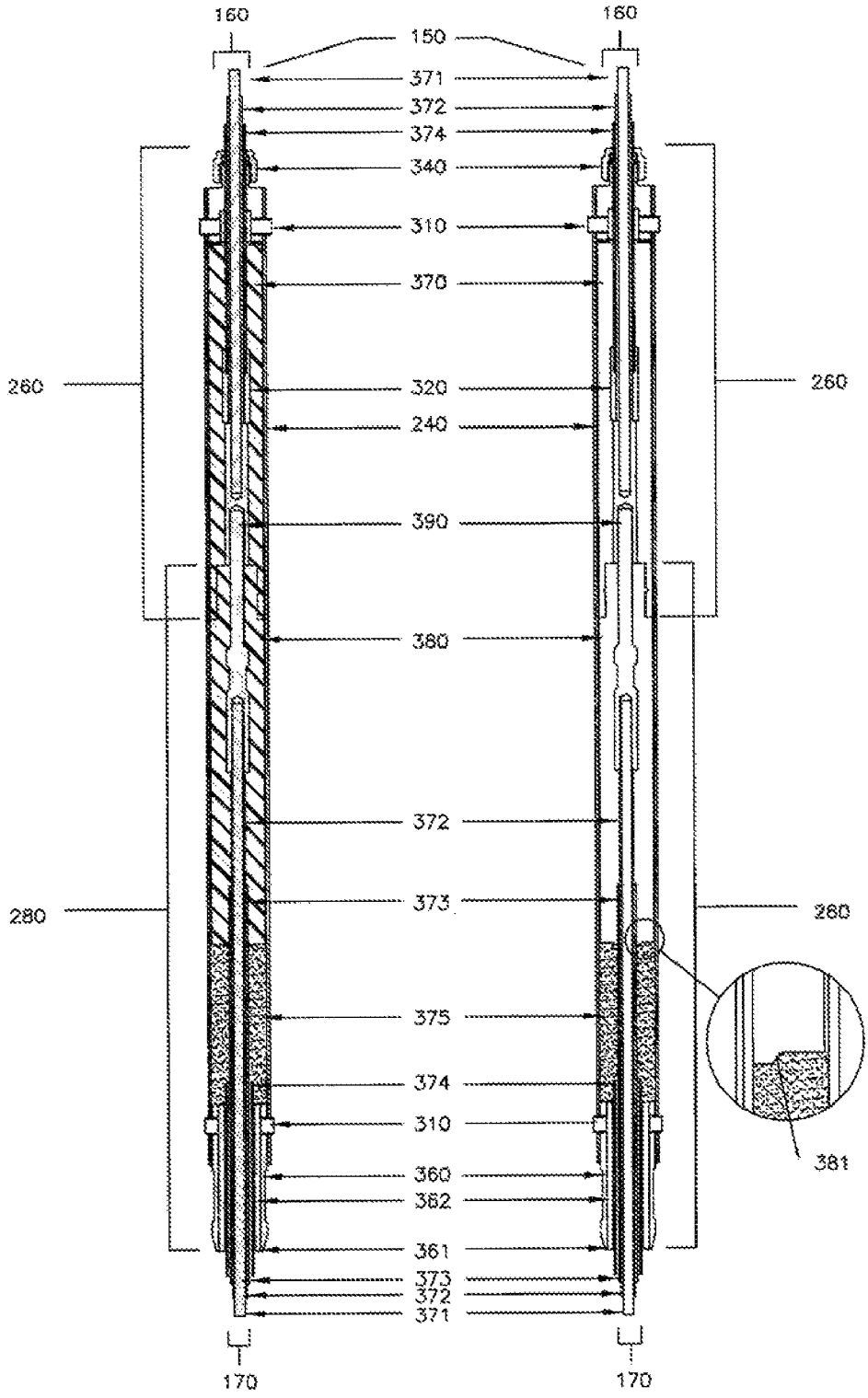
FIGS. 3A and 3B are sectional views of an example connector in which a male connector assembly is plugged into a female connector assembly and secured within a protective outer sleeve.

A preferred embodiment of the down hole connector 150 is shown in FIGS. 3A and 3B in a cross sectional view. The connector 150 is comprised of a top stop assembly 340, female boot 370, and green hooter 320 (collectively the "female connector assembly 260"). The connector 150 is also comprised of a conductor pin 390, male boot 380, encasing material 375, bushing 362, and bottom stop assembly 360 (collectively the "male connector assembly 280"). The connector 150 also includes a protective outer sleeve 240 that protects and engages the electrically terminated cables 160 and 170 and may be secured by stop screws 310 to the male and female connector assemblies.

One aspect of the connector is directed to the female connector assembly 260. As shown in FIGS. 3A and 3B, the female connector assembly is formed by top stop assembly 340 that secures and engages cable 160 with a compression fitting. The compression fitting preferably comprises a compression nut that tightens against a threaded portion of top stop 340. As the nut threads, it forces a ferrule against the protective tubing 374. The nut is preferably tightened until the ferrule slightly deforms tubing 374 and creates a seal. The bushing also seals against cable 160's protective tubing by tightening the stop screws 310 into the top stop's threaded holes. A non-extrusion washer is positioned between the bushing and female boot 370 to prevent the boot from expanding during a pressure event. The female boot 370 engages and supports the cable 160 and a green hooter 320 so that cable 170 can be electrically terminated.

The green hooter is an insulator of a generally cylindrical in shape with a longitudinal inner bore hole. The green hooter is formed with a counterbore at the mouth of the inner bore hole. The counterbore receives and engages a portion of the rigid tubing 374. The green hooter's inner bore hole engages and separates (or stands-off) the insulation 372, while holding the conductor wire 371 in an open channel in the female boot so that it can be electrically terminated. The green hooter also functions as a protective layer shielding cable 160 from well fluid and pressure.

Another aspect of the invention is directed to the male connector assembly 280. The top of the male connector assembly 280 includes a conductor pin 390 that is engaged by the male boot 380. The male connector assembly is shown in FIGS. 3A, 3B, 4A, and 4B where like structures are identified with like reference numerals. As shown in these figures, portions of the conductor pin have a greater diameter than others to prevent the pin from moving in the male boot 380. The conductor pin is formed with a counter bore that receives and engages cable 170's conductor wire 371. Insulation 372 is trimmed to expose the engaged portion of the conductor. The male boot 380 also preferably engages a portion of the lead jacketing 373 and insulation 372, which are preferably trimmed from cable 170 as shown in the figures.

Another aspect of the invention is directed to the unique fluid tight seal of the male connector assembly 280. The seal is formed, in part, by an encasing material 375 that prevents fluid from reaching permeable materials and conductive structures in the connector 150. The encasing material preferably encircles and/or adheres to the conductor wire's lead jacketing 373 and a portion of cable 170's protective tubing 374. In the preferred embodiment, the encasing material is an epoxy substance such as an epoxy putty. A particularly preferred epoxy putty is MSDS NAME: H14M06, MSDS #664454053, sold under the brand name AQUAMEND® by Polymeric Systems, Inc., 723 Wheatland Street, Phoenixville, Pa. 19460, USA.

The encasing material is preferably placed over the insulated conductor wire (either leaded, or non-leaded) in protective tubing in a position in a position between the male boot 380, and the bottom stop 360. Preferably, the conductive wire 371 is covered with lead jacketing 373 and the encasing material fully fills the space between the protective outer sleeve 240 and the lead jacketing so as to eliminate air pockets. Male boot 380 also provides a chamfered edge 381 thereby compressing as the epoxy, the fluid impervious encasing material, 375 is moved around the distal end of the boot 380. The lead jacketing 373 preferably extends into the male boot 380, beyond the encasing material 375, as shown in FIGS. 3A, 3B, 4A, and 4B. Alternatively, the conductive wire 371 is not covered with a lead jacketing 373, in which case, the encasing material covers at least a portion of the protective tubing 374 or other protective material covering the conductor wire 371 beyond the bottom stop assembly. The encasing material prevents well fluids from coming into contact and permeating the insulation. As a result, the insulation does not shrink or swell in diameter, which in turn prevents risk of a disconnect. The encasing material 375 also prevents cable 170 from being ejected during a pressure event.

The seal is also formed, in part, by securing the bottom stop assembly 360, bushing 362, and cable 170 inside the protective outer sleeve 240, as shown in FIGS. 3A and 3B. Preferably, the protective outer tubing 374 engages the bottom stop 360 and bushing 362 and presses against the protective tubing 374 to form a relatively rigid connection. Little or no fluid can pass between the structures into the male connector assembly 280 once the connection is made. Stop screws 310 thread into holes in the bottom stop and aligned holes in the protective outer sleeve to tighten the connection. The aforementioned structures are preferably capable of being adhered to by the fluid impervious encasing material 375 so that any fluids that do pass between the structures do not pass further into the male connector assembly 280.

In the preferred embodiment, the protective tubing 374 is comprised of one of the legs of a triskelion 220. As shown in FIG. 2, the triskelion protects, separates, and covers the individual insulated conductor wires 371 that extend from cable 170. The triskelion is preferably formed from a non-ferromagnetic electrically conductive material, such as nickel-plated brass or stainless steel, for example.

Figures 4A, 4B:
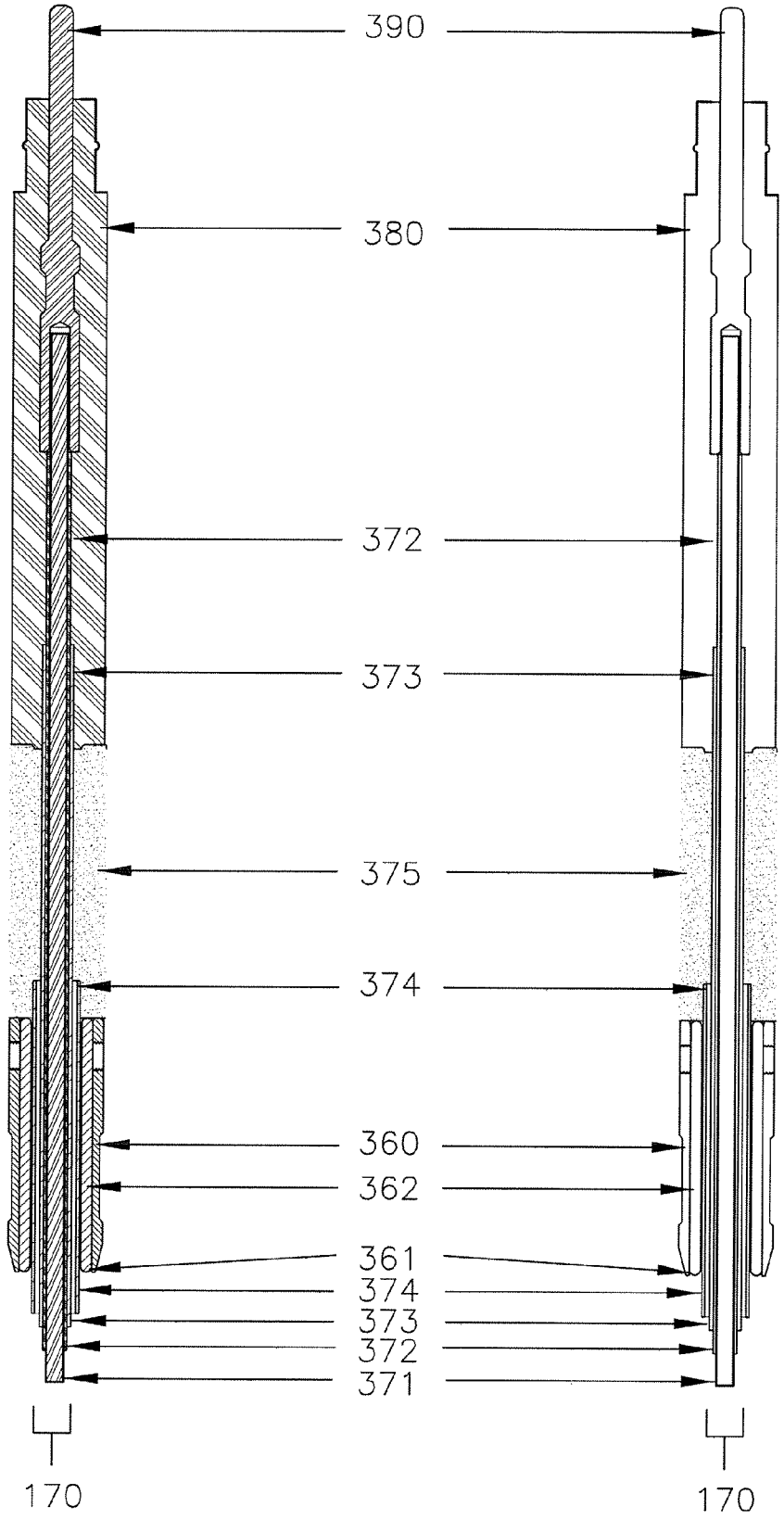
FIGS. 4A and 4B show a partial sectional view of an example male connector assembly.

FIGS. 4A and 4B show an optimal fluid tight seal. To establish the seal, the terminus of the triskelion (or other protective tubing 374) extends approximately two (2) inches through and past the terminus of the bottom stop assembly 360, toward the male boot 380, so that the bottom stop slides at least partially over the leg of the triskelion. Alternatively, the triskelion extends greater than or less than two inches through the bottom stop assembly. This is preferable to designs in which the bottom stop shoulders against the triskelion because, in the improved design, the triskelion's rigid tubing can be tightly secured and engaged by the bottom stop assembly 360 and bushing.

The bushing 362 is preferably a one-piece plastic material that is slightly compressible, and of an appropriate diameter to receive and engage the protective tubing. The protective outer sleeve 240 is preferably a rigid metal or plastic, or comparable fluid impermeable material, with and appropriate diameter to receive and engage the bushing and bottom stop assembly. The bottom stop and protective outer sleeve have a threaded straight bore all the way through each structure so that the stop screws contact the bushing when tightened.

The bottom stop 360 is preferably made of a non-ferromagnetic, electrically conductive material, such as stainless steel, for example. The bottom stop 360 includes an opening or counter bore 361 for receiving and engaging the bushing 362 and the protective tubing 374. The protective tubing, which is made of a lead or non-lead material, fits reasonably tightly into the bushing and this into the counter bore 361 so that it can be easily engaged. In one embodiment, the bushing 362 is omitted and the bottom stop screws tighten against the protective tubing 374 itself, or other material covering the conductor wire, to lock cable 170 in place within the bottom stop assembly.

The above described connector 150 overcomes the problems of the current art. The connector is effective to maintain a mechanical connection no matter how much shifting occurs between the connected cables. The connector also prevents fluids from migrating into and through the connector 150 to hazardous areas. The connector is even effective to prevent fluid migration over several days without causing any problems to the overall electrical system. Rapid decompression events in the well do not cause structures of the connector 150 to mechanically swell in diameter, shrink in length, split, and otherwise become destroyed.

The above noted aspects of the male connector assembly are particularly effective during rapid decompression events. The cable insulation material inside the male boot that previously tended to "milk" (e.g. escape) out of the back of the male boot to the bottom stop assembly has been eliminated, and as a result, the cable does not split and arc faults no longer occur behind the male boot or inside the bottom stop assembly.

Figures 5A, 5B:
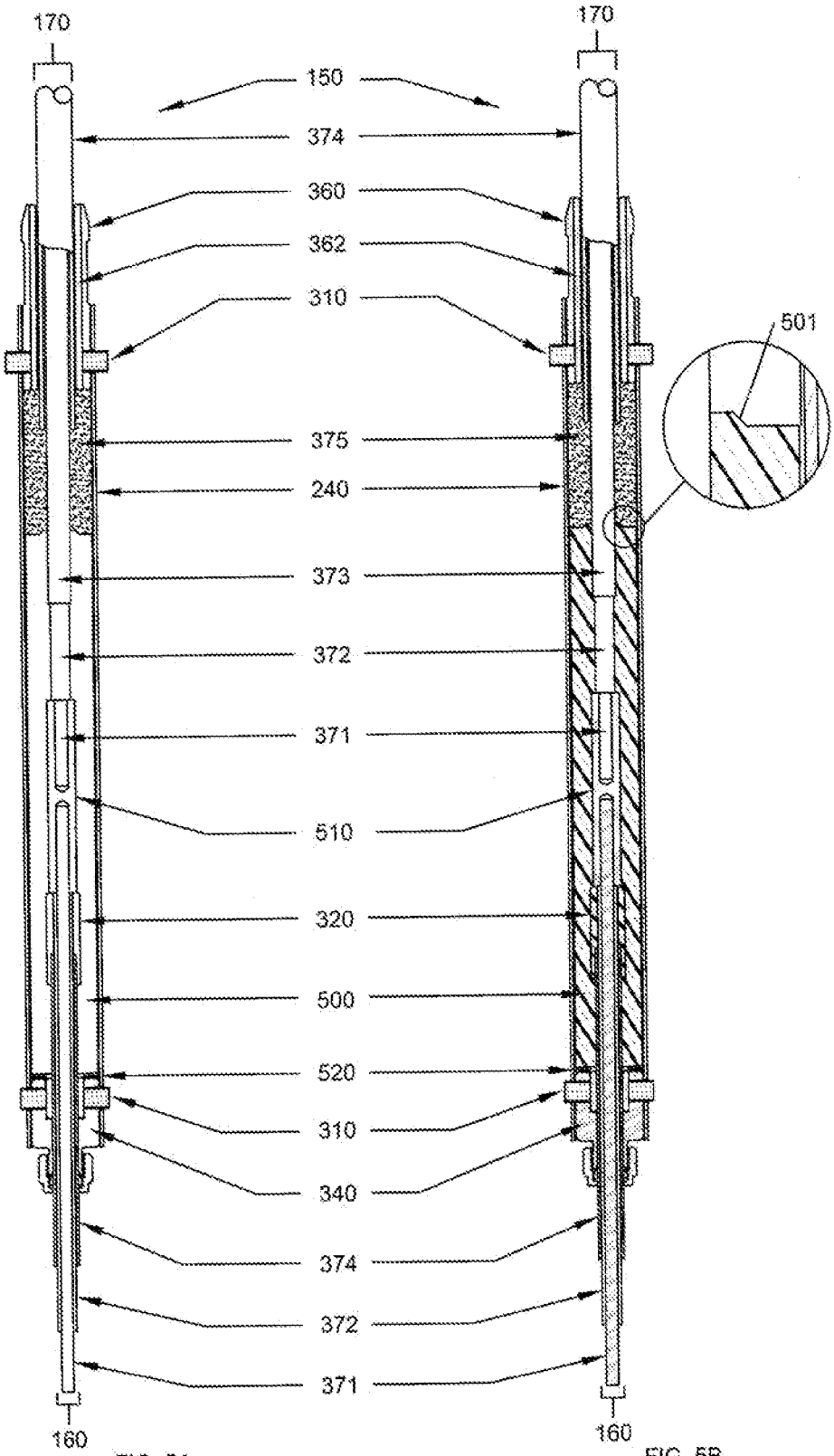
FIGS. 5A and 5B show sectional views of an example reusable hardwire connector.

FIGS. 5A and 5B show a reusable "hardwire connector" embodiment. The hardwire connector incorporates the fluid tight seal previously described. However, rather than plugging and unplugging with male and female connector assemblies, like the connector described in FIGS. 3A, 3B, 4A, and 4B, the hardwire embodiment is disconnected by cutting off the connector and replacing it with a new connector.

As shown in FIGS. 5A and 5B, the hardwire connector 150 comprises a single, preferably one-piece, boot 500 and a crimp sleeve 510 that electrically and mechanically connect cable 160's and 170's conductor wires 371. The crimp sleeve 510 is preferably constructed of a conductive material, such as copper, which has sufficiently rigidity and strength to hold each of the conductor wires in a mechanical and electrical connection. A suitable crimping tool is used to apply a pinching force to the crimp such that the crimp wraps, at least partially, around the conductor wires. Once crimped, the terminated conductor wires preferably do not disconnect.

The single piece insulating boot 500 is formed with an internal passage that is positioned to engage, insulate and protect the crimp sleeve 510. The single piece boot also engages and covers the green hooter 320 and insulated conductor wires in protective tubing of cables 160 and 170, as shown in FIGS. 5A and 5B. The insulating boot is therefore sufficiently long to cover at least a portion of cable 160 and cable 170. The insulating boot is preferably constructed ethylene propylene diene monomer rubber ("EPDM rubber"); however, various other insulating materials, such as plastic or rubber-like polymers, may also be used.

In the preferred embodiment, cable 160 is a penetrator and cable 170 is pump cable fitted with a triskelion. In this embodiment, the single piece boot 500 covers (i) the penetrator tubing and any exposed insulation, and (ii) the pump cable's insulation and protective lead jacket (if present), for example.

As shown in FIGS. 5A and 5B, connector 150 engages cable 170 in substantially the same manner as the male connector assembly 280 engages cable 170 in FIGS. 3A, 3B, 4A and 4B. The upper edge of the boot 500 in FIG. 5B provides a chamfered edge 501 which compresses the epoxy 375 against the edge of the protective tubing 373. Similarly, connector 150 engages cable 160 in substantially the same manner as the female connector assembly 260 engaged cable 160 in FIGS. 3A, 3B, 4A and 4B. It should be appreciated that like structures are identified with like reference numerals in the figures and, while redundant descriptions are omitted herein for purposes of brevity, the description of the structures shown in one figure apply equally to the structures shown in other figures unless noted otherwise.

Figures 6A, 6B, 6C:
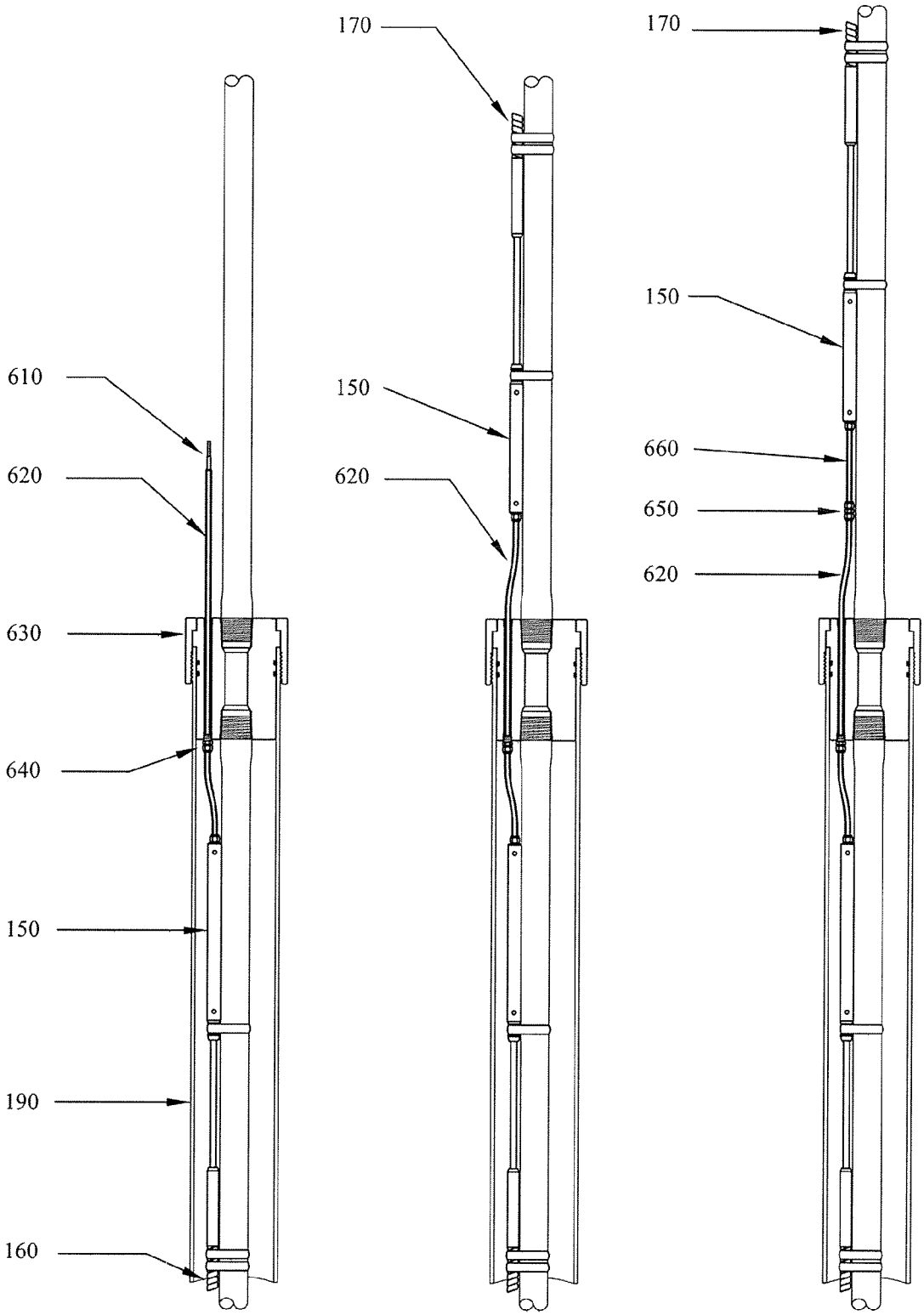
FIGS. 6A, 6B, and 6C show additional example embodiments of a hardwire reusable connector being installed on a penetrator.

FIGS. 6A, 6B, and 6C show the preferred embodiment of the reusable hardwire connector in which cable 160 is a penetrator and cable 170 is a pump cable. In FIG. 6A, only the lower portion of the penetrator is shown, as the upper side is not yet terminated. A swagelok fitting, or other suitable coupling means allows the penetrator tubing to couple with the down hole packer 630. Below the packer, a male and female connector couple to the production tubing by cable bands. One of skill in the art will recognize that although the figures show a side view of only one of the cables' wire in protective tubing, embodiments of the invention may be directed to more than one of the cables' conductor wires.

The penetrator cable preferably connects with the above ground power source (not shown). To make the connection, one or more of the penetrator wires 610 are partially exposed as shown in FIG. 6A. The penetrator's insulation and protective tubing 620 are preferably trimmed from the penetrator wire 610 so that connector 150 can be attached. The penetrator is preferably coupled by a swagelok fitting 640 or similar coupling means below the packer.

As shown in FIG. 6B, connector 150 is attached to the top portion of the penetrator to mechanically and electrically terminate the surface power source. The connector 150 in FIG. 6B is preferably the hardwire connector shown in FIGS. 5A and 5B, however, the male and female connectors of FIGS. 3A, 3B, 4A, and 4B may also be used. Once attached, down hole equipment can be operated.

As an alternative to the installation shown in FIG. 6B, the top portion of the penetrator 620 is fitted with a tube union 650 and penetrator tube extension piece 660. The tube union preferably comprises an appropriate swagelok fitting, or comparably made coupling means, for joining the penetrator tubing 620 with the extension piece 650. The extension piece provides an extension to the penetrator and is made of a short conductive wire housed in protective rigid tubing. The extension piece's conductor wire is partially exposed and its insulation and protective rigid tubing are trimmed so that the extension can be attached to connector 150 according to preferred and alternative embodiments of the invention. For increased efficiency, the extension piece can be uncoupled FIGS. 3A, 3B, 4A and 4B Cable 170 can also be cut off above connector 150, so that it can be discarded.

Figures 7A, 7B, 7C, 7D, 7E:
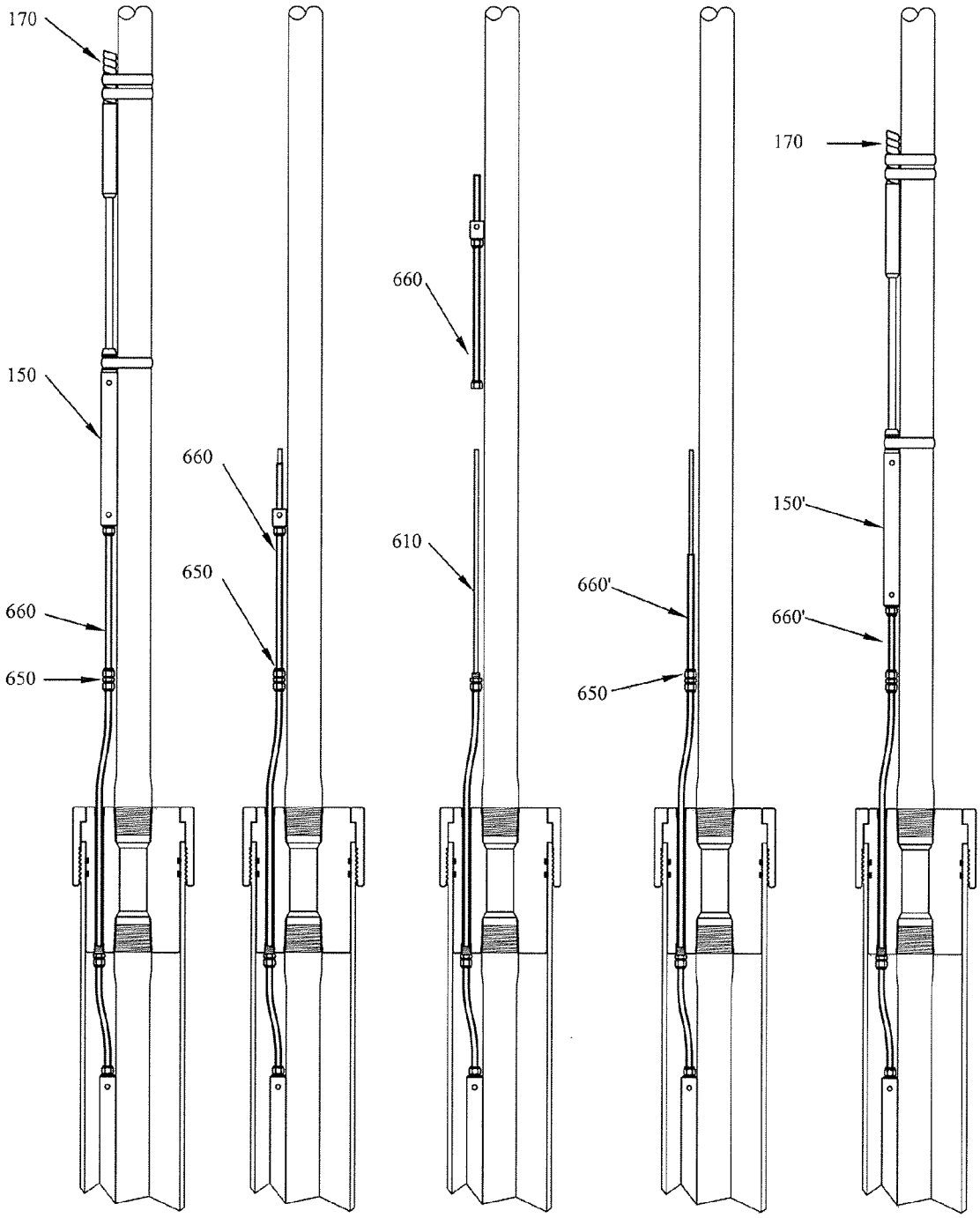
FIGS. 7A, 7B, 7C, 7D, and 7E show an example sequence for installing an example hardwire reusable connector on a penetrator.

FIGS. 7A, 7B, 7C, 7D, and 7E show the preferred sequence for removal and installation of the hardwire connector with an extension piece. The sequence begins with FIG. 7A, where the penetrator tube extension piece 660 is shown attached to the penetrator by connector 150. The connector is removed, as shown in FIG. 7B, at the drilling operator's option for any number of reasons. Next, the tube union 650 is disconnected and the penetrator tube extension piece is removed, leaving the insulated penetrator wire 610 exposed, as shown in FIG. 7C.

Next, as in FIG. 7D, a new penetrator tube extension piece 660' is attached to the tube union 650. The new extension piece replaces the exposed insulated wire from the penetrator's extension piece 610. The new extension piece is preferably shorter than the original.

Finally, a new hardwire connector 150' is attached to the new tube extension 660' as shown in FIG. 7E. Once attached, the down hole equipment is terminated at the above ground power source and ready for operation.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. For example, to the extent the structures shown in FIGS. 1-8 are not otherwise described or enabled herein, U.S. patent application Ser. No. 11/830,206, titled Electrical Connector For Conductor Wires Encapsulated In Protective Tubing, by Tod D. Emerson, is incorporated by reference herein in its entirety for such purpose. Furthermore, as one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A rapid-decompression-inhibiting electrical connector sub-assembly comprising:

a protective outer sleeve;

an insulating elastomeric boot;

a bottom stop assembly providing a bushing accommodating the insertion of a protective outer tubing;

an insulated electrical conductor inserted through the protective outer tubing into the insulating elastomeric boot; and, a fluid-impervious encasing material filling the interior space of the protective outer sleeve between the interior of the bottom stop assembly and the insulating elastomeric boot.

2. The rapid-decompression-inhibiting electrical connector sub-assembly of claim 1 further comprising a chamfered edge of the insulating elastomeric boot adjoining the fluid-impervious encasing material, compressing against an exterior of the insulated conductor inserted into the insulating elastomeric boot.

3. The rapid-decompression-inhibiting electrical connector sub-assembly of claim 1 wherein the insulating elastomeric boot comprises a male boot and a female boot.

4. The rapid-decompression-inhibiting electrical connector sub-assembly of claim 1 wherein the insulated electrical conductor is covered by a lead jacket.

5. The rapid-decompression-inhibiting electrical connector sub-assembly of claim 1 wherein the bottom stop assembly is adapted for engaging the protective outer tubing of a down hole conductor about two inches from the terminus of the protective outer tubing.

6. A decompression-resistant down hole connector comprising:

a protective outer sleeve;

a top stop assembly for receiving and engaging a first down hole electrical cable; wherein the top stop assembly, having a ferrule compressively seated against a first protective outer tubing, provides a metal to metal connection on the first protective outer tubing on the first down hole electrical cable;

a bottom stop assembly for receiving and engaging a second protective outer tubing of a second down hole electrical cable that electrically terminates with a connection to the first down hole electrical cable; wherein the bottom stop assembly is positioned at least partially within the protective outer sleeve enclosing the second protective outer tubing extending through a bushing within the bottom stop assembly into an interior of the protective outer sleeve;

at least one insulating elastomeric boot with an axial passage for supporting the terminated first and second down hole electrical cables within the protective outer sleeve; and an epoxy filling the area between the second protective outer tubing and the protective outer sleeve, said epoxy encasing the second down hole electrical cable inserted in the insulating elastomeric boot through the bottom stop assembly.

7. The decompression-resistant down hole electrical connector of claim 6 wherein an outer edge of the at least one insulating elastomeric boot is chamfered to seal around the second electrical cable inserted into the insulating elastomeric boot upon the compression of the space-filling epoxy encasing the cable.

8. The decompression-resistant down hole electrical connector of claim 6 wherein the insulating elastomeric boot comprises a first male boot and a separate second female boot.

9. The decompression-resistant down hole connector of claim 6 wherein the first down hole electrical cable is a penetrator cable.

10. The decompression-resistant down hole connector of claim 6 wherein the second down hole electrical cable is a pump cable.

11. The decompression-resistant down hole connector of claim 6 wherein the protective outer tubing extends about two inches past the bottom stop assembly.

12. A method for providing the down hole connector of claim 6 comprising the steps of:

receiving and engaging the at least one down hole electrical cable with a protective outer sleeve, wherein the down hole electrical cable is formed with a cable at least partially encapsulated in protective tubing, extending concentrically interior to the protective outer sleeve; and, inserting the protective tubing and electrical cable into the interior of the protective outer sleeve extending beyond the bottom stop assembly; and encasing the electrical cable and protective tubing of the down hole electrical connector in the epoxy within the protective outer sleeve to prevent expansion and splitting of the insulation of the electrical cable;

enclosing the exposed portion of the outer surface of at least one down hole electrical cable extending concentrically from the protective tubing; and forming the connection between the protective outer sleeve and the protective tubing of the down hole electrical cable.

13. The method of claim 12 further comprising the step of positioning a bottom stop assembly at least partially within the protective outer sleeve and adjacent to the encasing material so that the bottom stop assembly receives and engages the down hole electrical cable.

* * * * *